US005154579A

United States Patent [19]

Rezek

[11] Patent Number: 5,154,579

[45] Date of Patent: Oct. 13, 1992

[54] CEILING FAN ASSEMBLY

[75] Inventor: Ron Rezek, Los Angeles, Calif.

[73] Assignee: Beverly Hills Fan Company, North Hollywood, Calif.

[21] Appl. No.: 729,304

[22] Filed: Jul. 12, 1991

[51] Int. Cl.[5] ..... B42F 13/00

[52] U.S. Cl. ..... 416/5; 403/114; 248/343

[58] Field of Search ..... 416/5, 244; 403/114, 403/115; 248/343

[56] References Cited

U.S. PATENT DOCUMENTS

| | | | |
|---|---|---|---|
| 560,569 | 5/1896 | Brinser . | |
| 623,601 | 4/1899 | Melzer . | |
| 636,871 | 11/1899 | Wait | 416/5 |
| 684,264 | 10/1901 | Kemmerer | 248/343 |
| 905,089 | 11/1908 | McBerty | 416/5 |
| 1,445,402 | 2/1923 | LeVelle | 416/5 |
| 1,812,614 | 6/1931 | Viken | 403/115 |
| 4,073,598 | 2/1978 | Mizuntani et al. | 416/5 |
| 4,357,506 | 11/1982 | Breining | 200/52 R |
| 4,402,649 | 9/1983 | Laurel | 416/5 |
| 4,634,345 | 1/1987 | Stanek et al. | 416/244 R |
| 4,697,777 | 10/1987 | Yang | 248/343 |
| 4,754,947 | 7/1988 | Propp | 248/343 |
| 4,878,806 | 11/1989 | Markwardt | 416/5 |
| 4,884,947 | 12/1989 | Rezek | 416/5 |
| 5,090,654 | 2/1992 | Ridings et al. | 248/343 |

FOREIGN PATENT DOCUMENTS

| | | |
|---|---|---|
| 101292 | 6/1983 | Japan . |
| 385772 | 1/1933 | United Kingdom . |
| 1208928 | 2/1971 | United Kingdom . |
| 1584264 | 11/1981 | United Kingdom . |

*Primary Examiner*—Edward K. Look
*Assistant Examiner*—Michael S. Lee
*Attorney, Agent, or Firm*—Rothwell, Figg, Ernst & Kurz

[57] ABSTRACT

A ceiling fan assembly wherein an upper ceiling ball attachable to a ceiling structure, a vertical shaft and a continuous cylindrical housing, which are both easily replaced with parts which are longer or shorter than the original parts so as to allow easy adjustment of the ceiling fan assembly's height, and which hang vertically from the upper ceiling ball so as to structurally support the ceiling fan assembly, wherein the top portion of the vertical shaft rests on a cushioning material within the upper ceiling ball so that the ceiling fan assembly can accommodate moderate ceiling structure angles, an electric fan drive motor located in a cylindrical enclosure beneath the cylindrical housing, a motor rotor assembly with a means for attaching fan blades which is located beneath the cylindrical motor enclosure, and, optionally, a partially hemispherical-shaped unit which may be located beneath the motor rotor assembly, wherein this unit may contain a light are present.

10 Claims, 1 Drawing Sheet

CEILING FAN ASSEMBLY

FIELD OF THE INVENTION

The present invention relates generally to ceiling fan assemblies.

BACKGROUND OF THE INVENTION

Ceiling fans, which commonly also include a light, are extremely useful and popular because of their ability to move and circulate air within a room. In order to operate, ceiling fans must have certain elemental parts. That is, they must have a means for supporting the fan from the ceiling, a motor drive, and fan blades. Typically, the sole means for supporting the fan from the ceiling is a down-rod which extends vertically throughout the height of the fan and which has one end attached, either directly or through a ceiling fixture, to a ceiling structure. The down-rod supports the ceiling fan assembly in that the fan's elemental parts are attached to the rod.

Because ceiling fans are so centrally visible when installed, they become part of the interior decoration of the room. Often, however, the elemental parts needed to make the fan operational are not aesthetically pleasing. Furthermore, using only a down-rod to structurally support a ceiling fan assembly greatly limits the number of decorative ceiling fan assembly configurations available to the public. It has proven extremely difficult to devise a ceiling fan assembly which utilizes conventional motors and supports and which also is aesthetically pleasing.

Thus, there is a need in the art for ceiling fan assemblies which are not only structurally sound and functional but also aesthetically pleasing.

SUMMARY OF THE INVENTION

The present invention provides a ceiling fan assembly which is not only functional but also aesthetically pleasing, which can accommodate ceiling structure angles of about 0° to about 40°, which is structurally supported by a vertical shaft acting in concert with a cylindrical housing component, and which has an adjustable height.

In accordance with the present invention, a ceiling fan assembly comprising an upper ceiling ball attachable to a ceiling structure, a vertical shaft and a continuous cylindrical housing, which are both easily replaced with parts which are longer or shorter than the original parts so as to allow easy adjustment of the ceiling fan assembly's height, and which hang vertically from the upper ceiling ball so as to structurally support the ceiling fan assembly, wherein the top portion of the vertical shaft rests on a cushioning material within the upper ceiling ball so that the ceiling fan assembly can accommodate moderate ceiling structure angles, an electric fan drive motor located in a cylindrical enclosure beneath the cylindrical housing, a motor rotor assembly with a means for attaching fan blades which is located beneath the cylindrical motor enclosure, and, optionally, a partially hemispherical-shaped unit which may be located beneath the motor rotor assembly, wherein this unit may contain a light.

DETAILED DESCRIPTION OF THE PREFERRED EMBODIMENT

Figure 1:
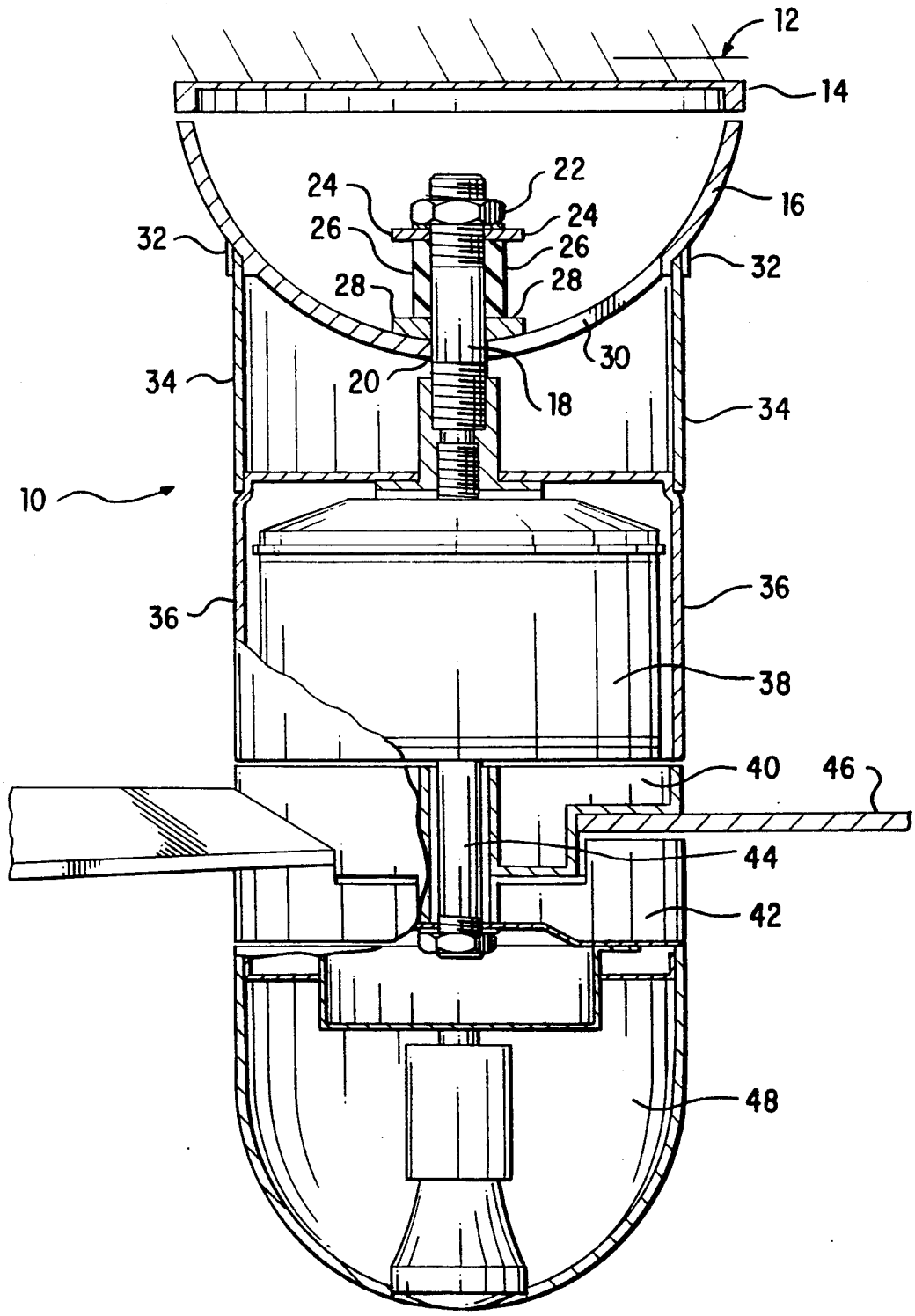
FIG. 1 is a cross-sectional, side elevation view showing the unique ceiling fan assembly of this invention.

A ceiling fan assembly 10 is provided for hanging from a ceiling structure 12. An upper ceiling ball 16 of a desired configuration may be attached directly to the ceiling structure 12 or it may be secured to a support pad 14 which is rigidly attached to the ceiling structure 12. In the center of the upper ceiling ball 16, there is an opening 20. A vertical shaft 18, which has a nut 22 and washers 24 attached to its top portion so as to give its top portion a larger diameter than the opening 20 has, protrudes through the opening 20 of the upper ceiling ball 16 so that the top portion of the vertical shaft 18 is inside the upper ceiling ball 16. Moreover, the vertical shaft 18 extends downward only to the top of the motor enclosure 36 which contains an electric fan drive motor 38.

The vertical shaft 18 is not attached to the ceiling structure 12 or to any ceiling fixture. The vertical shaft 18 rests on cushioning material 26 located between the top portion, including the nut 22 and washers 24, of the vertical shaft 18 and a collar 28 located on the lower inner surface of the upper ceiling ball 16. Even though it is not attached to the ceiling structure 12, the vertical shaft 18 in the present invention still provides some structural support to the ceiling fan assembly 10.

According to one preferred embodiment of the present invention, springs are used as cushioning material 26 located between the top portion, including the nut 22 and washers 24, of the vertical shaft 18 and a collar 28 located on the lower inner surface of the upper ceiling ball 16. By spring loading the vertical shaft 18 in this manner, the ceiling fan assembly 10 becomes adjustable so that this assembly will be able to accommodate ceiling structure angles of about 0° to about 40°. Slot 30 in the upper ceiling ball 16 allows for this angular adjustment.

According to one aspect of the present invention, a continuous cylindrical housing 34 extends downward from the upper ceiling ball 16 to the top of the motor enclosure 36 which contains an electric fan drive motor 38. The top of the cylindrical housing 34 abuts against the lower outer surface of the upper ceiling ball 16. This abutment is cushioned by a gasket located inside a collar 32 on the outside surface of the upper ceiling ball 16. Any type of gasket known in the art, preferably plastic gaskets, can be used to cushion this abutment. It is through the attachment of the cylindrical housing 34 to the upper ceiling ball 16 that the cylindrical housing 34 is able to provide some structural support to the ceiling fan assembly 10. Thus, the cylindrical housing 34 works in concert with the vertical shaft 18 to structurally support the ceiling fan assembly 10. The cylindrical housing 34 supports the compression member of the fan assembly while the vertical shaft 18 supports the tension member of the fan assembly.

In the present invention, both the vertical shaft 18 and the cylindrical housing 34 can be easily replaced with parts of different heights as long as the replacement cylindrical housing 34 and the replacement vertical shaft 18 have the same height. Accordingly, the height of the ceiling fan assembly 10 can be adjusted by replacing the cylindrical housing 34 and vertical shaft 18 with parts which are longer or shorter than the original parts.

Directly beneath the cylindrical housing 34 is the enclosure 36 which contains an electric fan drive motor 38. Since the electric fan drive motor 38 is located in the enclosure 36 and therefore is not exposed, the amount of noise which emanates from the drive motor 38 during operation of the fan may be reduced and the ceiling fan assembly 10 may be safer.

Positioned beneath the enclosure 36 is a motor rotor. As is known in the art, the rotor is driven by the shaft 44 which is part of the electric fan drive motor 38. The motor rotor is in two parts: the upper rotor 40 and the lower rotor 42. The upper rotor 40 and the lower rotor 42 can be combined, by any method known in the art such as by clamping them together, to form the motor rotor assembly. Combining the upper rotor 40 with the lower rotor 42 provides a secure place of attachment for the fan blades 46. The fan blades 46 are attached to the ceiling fan assembly 10 in between the upper rotor 40 and the lower rotor 42. Combining the upper rotor 40 with the lower rotor 42 keeps the fan blades attached to the ceiling fan assembly during the fan's operation.

Typically, there are a plurality of fan blades 46 attached to the ceiling fan assembly 10. According to one preferred embodiment, four fan blades are inserted in between the upper rotor 40 and the lower rotor 42 at a pitch of about 12°.

The individual parts of the ceiling fan assembly 10 can be made up of materials which are well-known in the art for being of use in ceiling fan assemblies. For example, the vertical shaft 18, upper ceiling ball 16, motor enclosure 36, upper rotor 40, and lower rotor 42 can be made up of any treated or untreated metallic material such as dicast aluminum. The fan blades 46 can be made up of materials such as metals, wood or plastics. Finally, the cylindrical housing 34 can also be made up of a treated or untreated metallic material. Preferably, the cylindrical housing 34 is made up of a material which is different from the materials used to make the other parts such as extruded aluminum.

According to one preferred embodiment of the present invention, a lower partially hemispherical-shaped unit 48 can be attached to the bottom of the lower rotor 42 by any means known in the art. Acceptable attachment means include, but are not limited to, nuts, bolts, screws, and brackets. Inside the lower ceiling ball 48 can be any type of light including, but not limited to, dome lights, incandescent lights, or halogen recessed lights. When the partially hemispherical-shaped unit 48 is attached to the rest of the ceiling fan assembly, the structure takes on a monolithic appearance.

As can be seen, this invention provides a unique assembly for allowing an aesthetically pleasing design of an adjustable ceiling fan assembly. Moreover, the ceiling fan assembly of the present invention contains an unique structural support system as it is supported, in part, by the cylindrical housing 34 which is attached to the upper ceiling ball 16.

What is claimed is:

1. A ceiling fan assembly comprising:

(a) an upper ceiling ball attachable to a ceiling structure;

(b) a shaft hung vertically from said upper ceiling ball, wherein said shaft comprises one end which protrudes into said upper ceiling ball through an opening in said upper ceiling ball;

(c) cushioning means located between the top portion of said shaft and said upper ceiling ball;

(d) housing means positioned vertically beneath and abutting said upper ceiling ball;

(e) gasket means positioned where said housing means abuts said upper ceiling ball;

(f) an electric fan drive motor, in an enclosure located beneath said housing means, the enclosure and housing means having similar surface configurations so as to enable the edge of said housing means and the edge of said enclosure to contact each other;

(g) a motor rotor assembly with a means for attaching fan blades to said ceiling fan assembly; and (h) a plurality of fan blades attached to said motor rotor assembly.

2. The ceiling fan assembly of claim 1 which further comprises (i) a lower partially hemispherical-shaped unit attachable to the ceiling fan assembly described in (a) through (h), having a dimension such that the lower partially hemispherical shaped unit gives the ceiling fan assembly a monolithic appearance.

3. The ceiling fan assembly of claim 2, wherein said lower unit contains a light.

4. The ceiling fan assembly of claim 1, wherein said cushioning means includes springs.

5. The ceiling fan assembly of claim 1, wherein the height of said ceiling fan assembly can be adjusted by replacing said housing means and said vertical shaft with parts which are longer or shorter than the original parts.

6. The ceiling fan assembly of claim 1, wherein said housing means is cylindrical.

7. The ceiling fan assembly of claim 6, wherein said housing means and said enclosure have the same diameter.

8. A ceiling fan assembly comprising an upper ceiling ball attachable to a ceiling structure, a shaft hung vertically from said upper ceiling ball wherein said shaft comprises one end which protrudes into said upper ceiling ball through an opening in said upper ceiling ball, an electric fan drive motor, a motor rotor assembly with a means for attaching fan blades to said ceiling fan assembly, and a plurality of fan blades attached to said motor rotor assembly, wherein the improvement comprises means for spring loading the ceiling fan assembly and a slot in said upper ceiling ball so as to enable the ceiling fan assembly to be adjustable to various ceiling structure angles.

9. A ceiling fan assembly comprising an upper ceiling ball attachable to a ceiling structure, a shaft hung vertically from said upper ceiling ball wherein said shaft comprises one end which protrudes into said upper ceiling ball through an opening in said upper ceiling ball, an electric fan drive motor, a motor rotor assembly with a means for attaching fan blades to said ceiling fan assembly, and a plurality of fan blades attached to said motor rotor, wherein the improvement comprises housing means positioned vertically beneath and abutting said upper ceiling ball so as to enable said housing means to provide structural support to the ceiling fan assembly.

10. The ceiling fan assembly of claim 9, wherein the height of the ceiling fan assembly can be adjusted by replacing said housing means and said vertical shaft with parts which are longer or shorter than the original parts.

* * * * *